US006701848B1

(12) United States Patent
Georgantzis et al.

(10) Patent No.: US 6,701,848 B1
(45) Date of Patent: Mar. 9, 2004

(54) ANTI-PERSONNEL CANISTER

(75) Inventors: Peter Georgantzis, E. Stroudsburg, PA (US); Angel F. Paredes, Oradell, NJ (US); Eric P. Scheper, Essex Fells, NJ (US); Henry E. Hudgins, Lord's Valley, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 43 days.

(21) Appl. No.: 10/065,673

(22) Filed: Nov. 7, 2002

(51) Int. Cl.[7] ..... F42B 12/64; F42B 12/62; F42B 12/24; F42B 12/56

(52) U.S. Cl. ..... 102/506; 102/522; 102/449; 102/462

(58) Field of Search ..... 102/506, 393, 102/494, 489, 449–453, 462, 463, 522

(56) References Cited

U.S. PATENT DOCUMENTS 2,343,818 A * 3/1944 Sweeley ..... 102/454
3,602,143 A * 8/1971 Critcher ..... 102/449
3,670,651 A * 6/1972 Mertens ..... 102/452
3,802,345 A * 4/1974 La Costa ..... 42/78
4,211,169 A * 7/1980 Brothers ..... 102/494
4,220,090 A * 9/1980 Fackler ..... 102/449
4,913,054 A * 4/1990 Petersen ..... 102/439
5,648,637 A * 7/1997 Clark, III ..... 102/438
5,796,031 A * 8/1998 Sigler ..... 102/520
5,939,664 A * 8/1999 Kapoor ..... 102/506
5,963,776 A * 10/1999 Lowden et al. ..... 419/64
5,970,878 A * 10/1999 Gardner ..... 102/449

* cited by examiner

*Primary Examiner*—Charles T. Jordan
*Assistant Examiner*—Bret Hayes
(74) *Attorney, Agent, or Firm*—Michael C. Sachs; John F. Moran

(57) ABSTRACT

An anti-personnel canister includes a generally cylindrical container having side walls, the side walls defining an enclosure with a generally concave surface at one end and an opening at another end; the side walls having an outer surface, the outer surface including a plurality of longitudinal grooves formed therein and, below the plurality of longitudinal grooves, a circumferential obturator groove; a plurality of submunitions disposed in the enclosure; a spacer disposed in the enclosure between the plurality of submunitions and the opening; and a cap disposed on the opening of the container, the cap having a top surface and including a pair of orthogonal grooves formed on the top surface.

20 Claims, 2 Drawing Sheets

ANTI-PERSONNEL CANISTER

FEDERAL RESEARCH STATEMENT

[The inventions described herein may be manufactured, used and licensed by or for the U.S. Government for U.S. Government purposes.]

BACKGROUND OF INVENTION

The invention relates in general to anti-personnel (APERS) munitions and in particular to a gun launched anti-personnel munition.

U.S. Pat. No. 3,956,990 incorporates a payload of layers of flechettes. However, this design requires an internal charge and a plurality of detonator systems to disperse the payload. This is a costly and complicated design thereby allowing for higher probability of failure.

U.S. Pat. No. 4,301,737 is a dual purpose APERS round. In addition to the anti-personnel capability, it also uses an armor piercing anti-tank penetrator core. This round is not practical in the event there is no tank target. It is also less effective because there is a reduced anti-personnel payload. This also increases the costs considerably.

U.S. Pat. No. 4,494,459 is also a dual purpose APERS round. However, unlike U.S. Pat. No. 4,301,737, this design uses a high explosive, armor piercing charge instead of the penetrator core. These both lack practicality due to the need of an armored target. This design is even more costly because there is an aft charge for the anti-personnel shrapnel.

U.S. Pat. No. 4,515,083, while called "anti-personnel," is not a gun fired ammunition. It is actually a hand-launched grenade. This contains an explosive, which turns the casing into shrapnel.

U.S. Pat. No. 4,580,500 is another dual purpose round. This design differs from the previous dual-purpose rounds in that both the anti-tank and the anti-personnel payload are mines. This design is not intended for the elimination of current personnel.

U.S. Pat. No. 4,583,461 is a canister with a payload of mini-bombs. The small bombs are ejected by the use of a charge (an ignitable propellant). The small bombs are deployed when the case reaches a specific height above the ground. This design is more suitable for a longer range.

A dual purpose round is disclosed, wherein the anti-tank portion is a high explosive charge, but the anti-personnel portion uses the fragmentation of the casing as the projectiles. This round is not desirable due to the duality of the design. It also has less effectiveness toward the anti-personnel portion due to the lack of payload.

A fragmentation projectile such as a single or dual purpose grenade or bomblet for a cargo projectile, is disclosed, wherein a fragmentation body the envelopes an explosive charge carrying casing, which fragmentation body comprises one or more fragmentation rings notched in axial direction.

U.S. Pat. No. 5,225,628 is specifically an anti-personnel round. This design utilizes a non-elastic collision projectile, which increases the effectiveness of each impact. However, this design has two major drawbacks. The first is that the canister must have an open end, which does not provide containment of the "Lead Wax Pellets". It also has temperature restrictions. This also requires an indicator that increases the cost.

U.S. Pat. No. 5,866,841 is a fragmentation grenade. Though its effective principle is similar the method of function is vastly different; requiring high explosive to provide the energy to the high speed fragments.

U.S. Pat. No. 5,936,183 is an anti-personnel area denial device. It is not a round and functions like a mine using a TASER electronic stun method to provide a temporary non-lethal effect. This device has a completely different operating principle and effective range.

SUMMARY OF INVENTION

One embodiment of the present invention is an anti-personnel canister comprising a generally cylindrical container having side walls, the side walls defining an enclosure with a generally concave surface at one end and an opening at another end; the side walls having an outer surface, the outer surface including a plurality of longitudinal grooves formed therein and, below the plurality of longitudinal grooves, a circumferential obturator groove; a plurality of submunitions disposed in the enclosure; a spacer disposed in the enclosure between the plurality of submunitions and the opening; and a cap disposed on the opening of the container, the cap having a top surface and including a pair of orthogonal grooves formed on the top surface.

The invention will be better understood, and further objects, features, and advantages thereof will become more apparent from the following description of the preferred embodiments, taken in conjunction with the accompanying drawings. Brief

DESCRIPTION OF DRAWINGS

In the drawings, which are not necessarily to scale, like or corresponding parts are denoted by like or corresponding reference numerals.

DETAILED DESCRIPTION

The APERS canister of the instant invention is a gun launched ammunition (round). It may be fired from, for example, a tank or artillery piece. The canister is designed for defeating groups of personnel at various ranges, as opposed to defeating tanks, armored personnel carriers, aircraft, or other vehicle targets. The goal of this type of ammunition, much like a shotgun, is to disperse the payload upon exiting the gun tube and achieve maximum dispersion thus eliminating the maximum number of enemy personnel. The payload may comprise round tungsten balls, steel rectangular prisms, or flechettes.

The effective range of the 105 mm canister is out to 500 meters. It is large enough to carry a payload capable of incapacitating an advanced squad of 10 men wearing winter gear. The cartridge is fired from standard United States Government military equipment with rifling typically used for firing 105 mm ammunition. The 105 mm canister has a plastic slip band in order to control the spinning of the projectile. There is no fuze on this round. In a preferred embodiment, the canister contains approximately 800–1000 tungsten balls, which are expelled upon muzzle exit.

Figure 1:
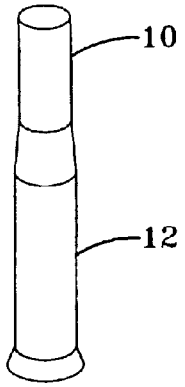
FIG. 1 is a perspective view of a gun fired round incorporating the APERS canister of the present invention.

FIG. 1 is a perspective view of a gun fired round incorporating the APERS canister 10 of the present invention. Canister 10 sits on cartridge 12. Cartridge 12, as is known in the art, is a combustible cartridge case loaded with propellant. An electric primer is fitted in the center of the propellant which when fired provides a flash and the gasses necessary to ignite the propellant. The burning propellant provides the gasses needed to force the canister 10 from the gun tube.

Figure 2:
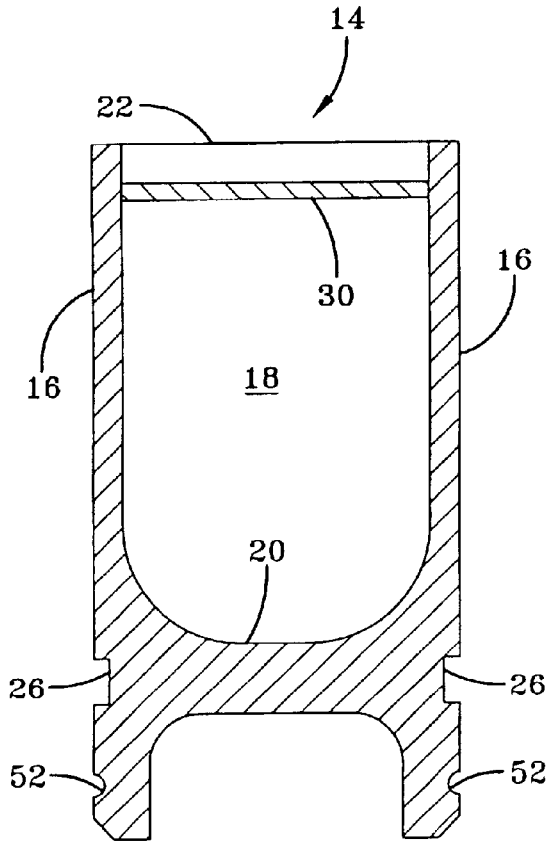
FIG. 2 is a sectional view of the canister of the present invention.
Figure 4:
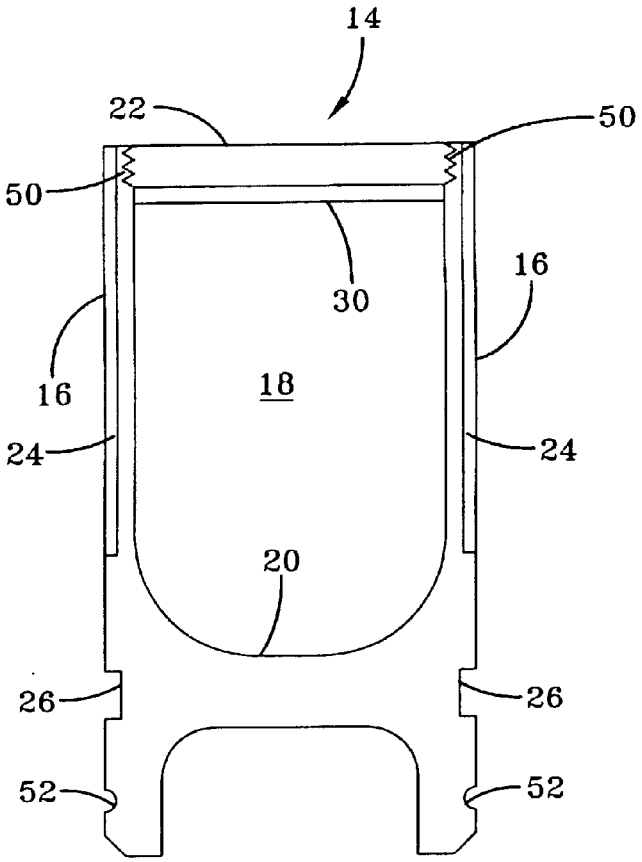
FIG. 4 is the sectional view of FIG. 2, without cross-hatching.

FIG. 2 is a sectional view of the canister 10 of the present invention. FIG. 4 is the sectional view of FIG. 2, without cross-hatching. Canister 10 comprises a generally cylindrical container 14 having side walls 16. The side walls 16 define an enclosure 18 with a generally concave surface 20 at one end and an opening 22 at another end. The outer surface of side walls 16 (see FIG. 4) include a plurality of longitudinal grooves 24 formed therein. Preferably, the plurality of longitudinal grooves 24 are equally spaced around the circumference of side walls 16. In a preferred embodiment, the number of longitudinal grooves 24 is four. Canister 10 is preferably made of steel.

Figure 5A:
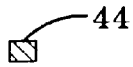
FIG. 5A is a sectional view of a slip ring and FIG. 5B is a sectional view of an obturator.
Figure 5B:
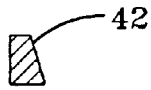

Below the plurality of longitudinal grooves 24 is a circumferential obturator groove 26. FIG. 5A is a sectional view of a slip band 44 and FIG. 5B is a sectional view of an obturator 42. Obturator 42 is disposed in the obturator groove 26. Plastic slip band 44 is disposed in the obturator groove 26 beneath the obturator 42. Slip band 44 reduces the spin imparted to canister 10 by rifling in the gun tube. A circumferential cartridge attachment groove 52 is disposed below the obturator groove 26 for attaching the container 14 to a cartridge case 12. In a preferred embodiment, the cartridge case is a 105 mm cartridge case.

Figure 3A:
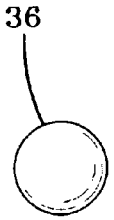
FIGS. 3A, 3B and 3C show various submunitions that fill the canister.
Figure 3B:
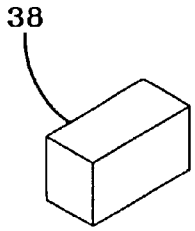
Figure 3C:
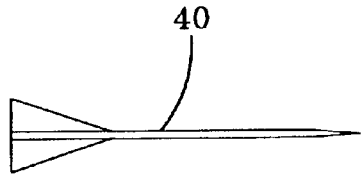

A plurality of submunitions are disposed in the enclosure 18, extending from the concave surface 20 to a spacer 30 disposed in the enclosure 18 between the plurality of submunitions and the opening 22. As shown in FIGS. 3A, 3B and 3C, the submunitions comprise one of balls 36, rectangular prisms 38 and flechettes 40. Rectangular prisms 38 may be made of steel. Preferably, the submunitons are balls 36 made of tungsten. The number of tungsten balls 36 is in the range of about 800 to about 1000.

Figure 6:
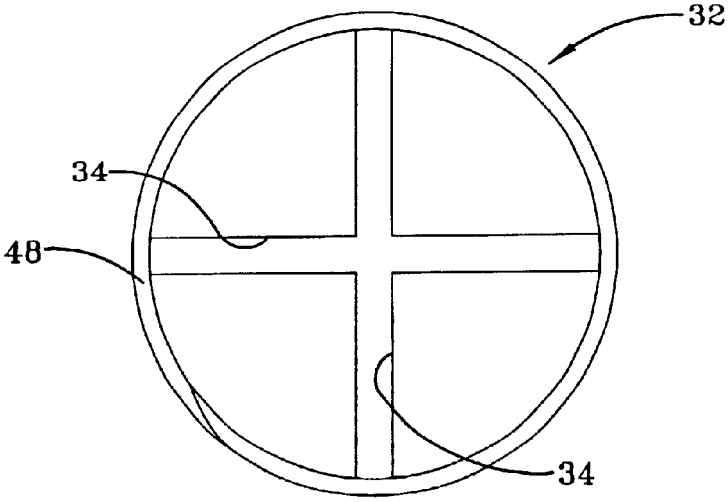
FIG. 6 is a top view of the cap for the canister.
Figure 7:
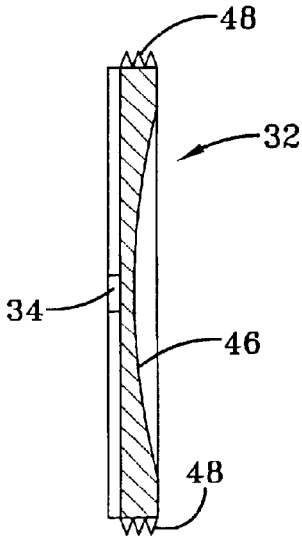
FIG. 7 is a sectional view of the cap of FIG. 6.

FIG. 6 is a top view of the cap 32 for the container 14. FIG. 7 is a sectional view of the cap of FIG. 6. The cap 32 is disposed on the opening 22 of the container 14. The cap 32 includes a pair of orthogonal grooves 34 formed on the top surface thereof. Cap 32 is preferably made out of aluminum and holds the payload of submunitions in place. As best seen in FIG. 7, a bottom surface of the cap 32 includes a reduced thickness concave portion 46. Cap 32 includes external threads 48 that mate with internal threads 50 on the inner surface of the side walls 16.

In one embodiment, the thickness of the cap 32 at the concave portion 46 is about 0.225 inches, the depth of the pair of orthogonal grooves 34 is about 0.15 inches and the width of the pair of orthogonal grooves 34 is about 0.16 inches. In addition, the width of the longitudinal grooves 24 is about 0.065 inches, the depth of the longitudinal grooves 24 is about 0.055 inches, the outside diameter of the container 14 is about 4.128 inches and the thickness of the side walls is about 0.239 inches.

When canister 10 exits the gun tube, air pressure bears on the two orthogonal grooves 34 (stress channels) in the cap 32. The air pressure, coupled with the four longitudinal stress grooves 24 on the side walls 16 and the centrifugal force caused by the rifled spinning, breaks the canister 10 apart, thereby deploying the submunitions contained therein.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An anti-personnel canister to be fired from a gun tube, comprising:

a generally cylindrical container having side walls, the side walls defining an enclosure with a generally concave surface at one end and an opening at another end;

the side walls having an outer surface, the outer surface including a plurality of longitudinal grooves formed therein and, below the plurality of longitudinal grooves, a circumferential obturator groove;

a plurality of submunitions disposed in the enclosure;

a spacer disposed in the enclosure between the plurality of submunitions and the opening;

a cap disposed on the opening of the container, the cap having a top surface and including stress grooves formed on the top surface; and wherein after the canister exits the gun tube, air pressure bearing on the stress grooves in the cap, coupled with the longitudinal grooves of the side walls and a centrifugal force resulting from a rifled spinning of the canister in the gun tube, cause the canister to break apart, allowing the submunitions contained in the container to be deployed.

2. The canister of claim 1 wherein the submunitions comprise one of balls, rectangular prisms and flechettes.

3. The canister of claim 2 wherein the balls comprise tungsten.

4. The canister of claim 2 wherein the rectangular prisms comprise steel.

5. The canister of claim 3 wherein a number of balls is in the range of about 800 to about 1000.

6. The canister of claim 1 wherein the plurality of longitudinal grooves are equally spaced around a circumference of the side walls.

7. The canister of claim 6 wherein a number of longitudinal grooves is four.

8. The canister of claim 1 further comprising an obturator disposed in the obturator groove.

9. The canister of claim 8 further comprising a slip band disposed in the obturator groove beneath the obturator to reduce spin imparted to the canister by rifling in the gun tube.

10. The canister of claim 1 wherein a bottom surface of the cap includes a concave portion.

11. The canister of claim 10 wherein a thickness of the cap at the concave portion is about 0.225 inches.

12. The canister of claim 11 wherein a depth of the pair of orthogonal stress grooves is about 0.15 inches.

13. The canister of claim 12 wherein a width of the pair of grooves is about 0.16 inches.

14. The canister of claim 1 wherein the cap includes external threads that mate with internal threads on an inner surface of the side walls.

15. The canister of claim 7 wherein a width of the longitudinal grooves is about 0.065 inches.

16. The canister of claim 15 wherein a depth of the longitudinal grooves is about 0.055 inches.

17. The canister of claim 1 wherein an outside diameter of the container is about 4.128 inches.

18. The canister of claim 16 wherein a thickness of the side walls is about 0.239 inches.

19. The canister of claim 1 wherein the outer surface of the side walls includes a circumferential cartridge attachment groove disposed below the obturator groove for attaching the container to a cartridge case.

20. The canister of claim 19 wherein the cartridge case is a 105 mm cartridge case.

* * * * *